US006928782B2

(12) United States Patent
Becker et al.

(10) Patent No.: US 6,928,782 B2
(45) Date of Patent: Aug. 16, 2005

(54) COLUMN HUNG TRUSS SYSTEM

(75) Inventors: Allan James Becker, Concord (CA); Zygmunt Dziwak, Mississauga (CA)

(73) Assignee: Aluma Enterprises Inc., Ontario ( * ) Notice: Subject to any disclaimer, the term of this patent is extended or adjusted under 35 U.S.C. 154(b) by 269 days.

(21) Appl. No.: 10/138,482

(22) Filed: May 6, 2002

(65) Prior Publication Data

US 2003/0205019 A1 Nov. 6, 2003

(51) Int. Cl.[7] ..... E04C 3/02; E04C 3/30
(52) U.S. Cl. ..... 52/696; 52/693
(58) Field of Search ..... 52/690, 693, 729.2, 52/729.1, 731.2, 730.5, 694, 695, 720.1, 729.5, 645, 650.1, 730.1, 731.1, 737.6; 249/19, 23, 18

(56) References Cited

U.S. PATENT DOCUMENTS

| | | | | | |
|---|---|---|---|---|---|
| 3,180,460 | A | * | 4/1965 | Liskey, Jr. | 52/479 |
| 3,778,175 | A | * | 12/1973 | Zimmer | 287/54 C |
| 4,102,108 | A | * | 7/1978 | Cody | 52/693 |
| 4,106,256 | A | * | 8/1978 | Cody | 52/646 |
| 4,350,318 | A | * | 9/1982 | Gallis | 249/40 |
| 5,729,944 | A | * | 3/1998 | De Zen | 52/439 |
| 6,519,908 | B1 | * | 2/2003 | Masterson et al. | 52/696 |
| 6,553,736 | B2 | * | 4/2003 | Montanaro et al. | 52/633 |

FOREIGN PATENT DOCUMENTS

| | | |
|---|---|---|
| DE | 840 435 | 6/1952 |
| DE | 14 34 335 | 4/1971 |
| EP | 0 380 953 | 8/1990 |
| FR | 988 705 | 8/1951 |
| GB | 2 036 150 | 6/1980 |

* cited by examiner

*Primary Examiner*—Gwendolyn Baxter

(57) ABSTRACT

An extruded metal structural component has a hollow generally rectangular section with the sides of the rectangular section adapted to interlock and engage with other structural components of the same cross section. The generally rectangular section includes on one side a shallow "U" shaped channel and the opposite side includes a projecting portion for mating receipt in the "U" shaped channel of a second structural component. The structural component includes a downwardly extending securing flange for engaging and securing connecting members when two such structural components form the top and bottom chord of a structural beam.

16 Claims, 15 Drawing Sheets

COLUMN HUNG TRUSS SYSTEM

FIELD OF THE INVENTION

The present application relates to truss systems used in the construction industry, and in particular, relates to a column hung truss system for forming of concrete floors.

BACKGROUND OF THE INVENTION

Flying form trusses are used to form concrete floors in multi-story structures. Some flying form truss systems transmit the poured concrete load directly to the floor slabs below and in fast construction cycles, the concrete floor below may not be fully cured. For this reason, reshoring of the lower concrete floor may be necessary to transmit the loads to a slab which is fully cured. Reshoring takes additional time and also limits the access to some lower levels which are effectively cured.

To overcome the above problems, it is known to use column mounted flying form truss systems designed to transfer the concrete load to the columns as opposed to the lower floors. Column mounted truss systems allow full access to the lower floors and the follow-up trades can be working on any floors which have been previously poured. With this arrangement, the construction cycle can be reduced.

Column mounted flying truss systems are most commonly used with flat slab construction but can accommodate shallow internal beams and spandrel beams. Any projection from the slab soffit increases the stripping distance the support jacks must lower the truss to allow removal.

Flying form systems typically use two large I-beams which run parallel to the building support columns with the I-beams being supported by shoring jacks secured to the columns. The shoring jacks are adjustable in height and typically have a roller associated therewith to allow lowering of the I-beams and sliding of the truss out of the formed bay. These I-beams have a series of transverse beams secured to and extending perpendicular to the I-beams. A series of runner beams which typically support a plywood deck are secured and extend perpendicular to the transverse beams.

The construction design of the building in combination with the expertise of the contractor typically determine whether a column hung truss system or a shoring frame truss system will be used. Column hung truss systems are often used for condominium and hotel construction, particularly when a short construction schedule is needed.

The transverse beams are of a length which is primarily determined by the width of the bays used in the building. The bay width is the distance between the columns. Surprisingly the bay width of different buildings varies substantially and thus different lengths of transverse beams are required. It is known to use composite transverse beams formed using U-shaped channel sections placed in back to back relationship and secured in an overlapping adjustable manner. Typically mechanical fasteners are used to secure the channels to form the appropriate length of transverse beams. It is desirable to produce relatively stiff transverse beams such that the spacing between the beams can be large, thereby reducing the number of transverse beams required and reduce the weight of the system. It is desirable that the overall weight of the flying truss be reduced to ease the movement thereof and to accommodate the crane capacity used for the building construction.

The present invention provides improvements to the transverse beams and improvements to truss systems used in concrete forming.

SUMMARY OF THE INVENTION

An extruded elongate metal component according to the present invention comprises in cross section, a hollow section having a top securing section first and second opposed side securing sections and a bottom securing section. The top securing section includes a recessed bolt slot extending the length of the structural component. The side sections have complimentary shapes with the first side securing section including a recess extending the length of the structural component, the second side securing section includes a projecting section sized for snug receipt in the recess of first side section. The bottom securing section includes at least one downwardly projecting securing flange extending the length of the structural component.

According to an aspect of the invention, the extruded elongate structural component is an extruded aluminum alloy component.

In a further aspect of the invention, the hollow section of the structural component is of a generally rectangular cross section.

In yet a further aspect of the invention, each side section has a series of holes extending therethrough and aligned with the holes through the other side section.

In yet a further aspect of the invention, the at least one downwardly projecting securing flange is two downwardly projecting securing flanges disposed in parallel relationship either side of the center line of the bottom section.

In yet a further aspect of the invention, the securing flanges include a series of securing holes passing therethrough and spaced in the length of the structural component.

In yet a further aspect of the invention, the recess in the first side section is a shallow U-shaped section which dominates the first side section and the projecting section of the side section includes opposed upper and lower shoulders for engaging sides of the shallow U-shaped section.

An assembled structural beam, according to the present invention, comprises a top chord and a bottom chord which are mechanically connected by a series of diagonal connecting members. The top chord includes on an upper surface, a longitudinally extending bolt slot. The bottom chord includes on a bottom surface, a longitudinally extending bolt slot. Each of the top chord and the bottom chord have two opposed side surfaces with a shallow channel recess in one side extending the length of the chord, and a complementary projection on the opposite side extending the length of the chord and sized for receipt in the shallow channel recess. Each of the top chord and the bottom chord are extruded components and include a securing flange which cooperates with the diagonal connecting members to secure the top chord to the bottom chord.

In an aspect of the structural beam, vertical connecting members are included.

In a preferred aspect of the invention, the top chord and the bottom chord of the assembled structural beam are of the same cross section.

In yet a further aspect of the invention, the top chord includes a hollow cavity extending the length thereof.

In yet a further aspect of the invention, the chords and the diagonal connecting members are extruded aluminum alloy components.

In yet a further aspect of the invention, the diagonal connecting members are secured to the chords using mechanical fasteners.

In yet a further aspect of the invention, the top chord includes on an upper surface a longitudinally extending bolt slot and the bottom chord includes on a bottom surface, a longitudinally extending bolt slot.

The present invention is also directed to a header beam which is adjustable in length. The header beam comprises two beam sections secured one to the other in an overlapping manner. Each beam section is an assembled structure having a cop chord, a bottom chord and a series of connecting members secured thereto between. The top chord and the bottom chord of the beams include interfitting surfaces which maintain longitudinal alignment of the beam sections relative to each other. The beam sections further include a series of holes in the top chord and bottom chords and a plurality of structural fasteners passing through aligned holes in the chords which in combination with the interfitting surfaces, mechanically secure the beam sections.

An adjustable in length header beam according to an aspect of the invention, as each of the beam sections being of the same cross section.

In yet a further aspect of the invention, the top chord and the bottom chord are of the same cross section.

In a further aspect of the invention, the chords are formed by extrusion and each chord has an extending member at one side and a corresponding receiving channel on the opposite side thereof.

In yet a further aspect of the invention, the header beam is stackable with like header beams with the interfitting surfaces engaging to partially maintain the stack of beams.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
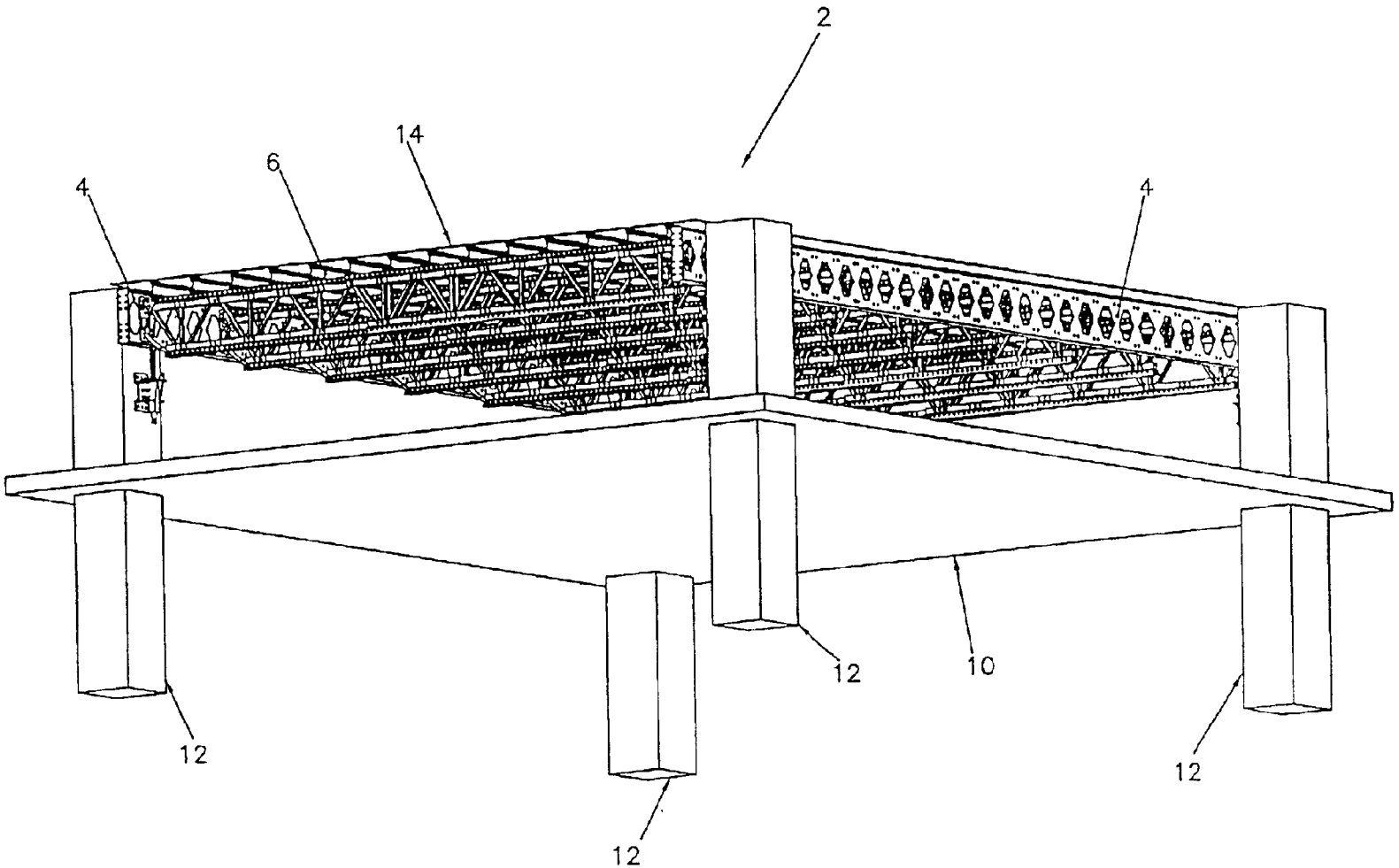
FIG. 1 is a perspective view of the column hung flying truss.

FIG. 1 schematically shows a bay of a building having the flying truss mounted to the columns in preparation for pouring of a concrete floor. The flying truss 2 has two main beams 4 which extend between columns 12 of the building and are supported by the columns by column mounted jacks 9 mechanically secured to the columns. The bay 11 of the building is generally the space between the columns 12. The main beams 4 have connected to them, a series of transverse beams 6 which are of a composite structure. These transverse beams are generally perpendicular to the main beams 4. A series of runner beams 8 are attached to the upper surface of the transverse beams 6 and support the plywood deck 14. Once the reinforced concrete floor 10 has been poured and partially cured, such that it can support its own weight, the flying truss may be lowered on the column jacks 9 and moved out of the bay in preparation for locating between the columns for pouring of the next floor or an adjacent bay.

Figure 2:
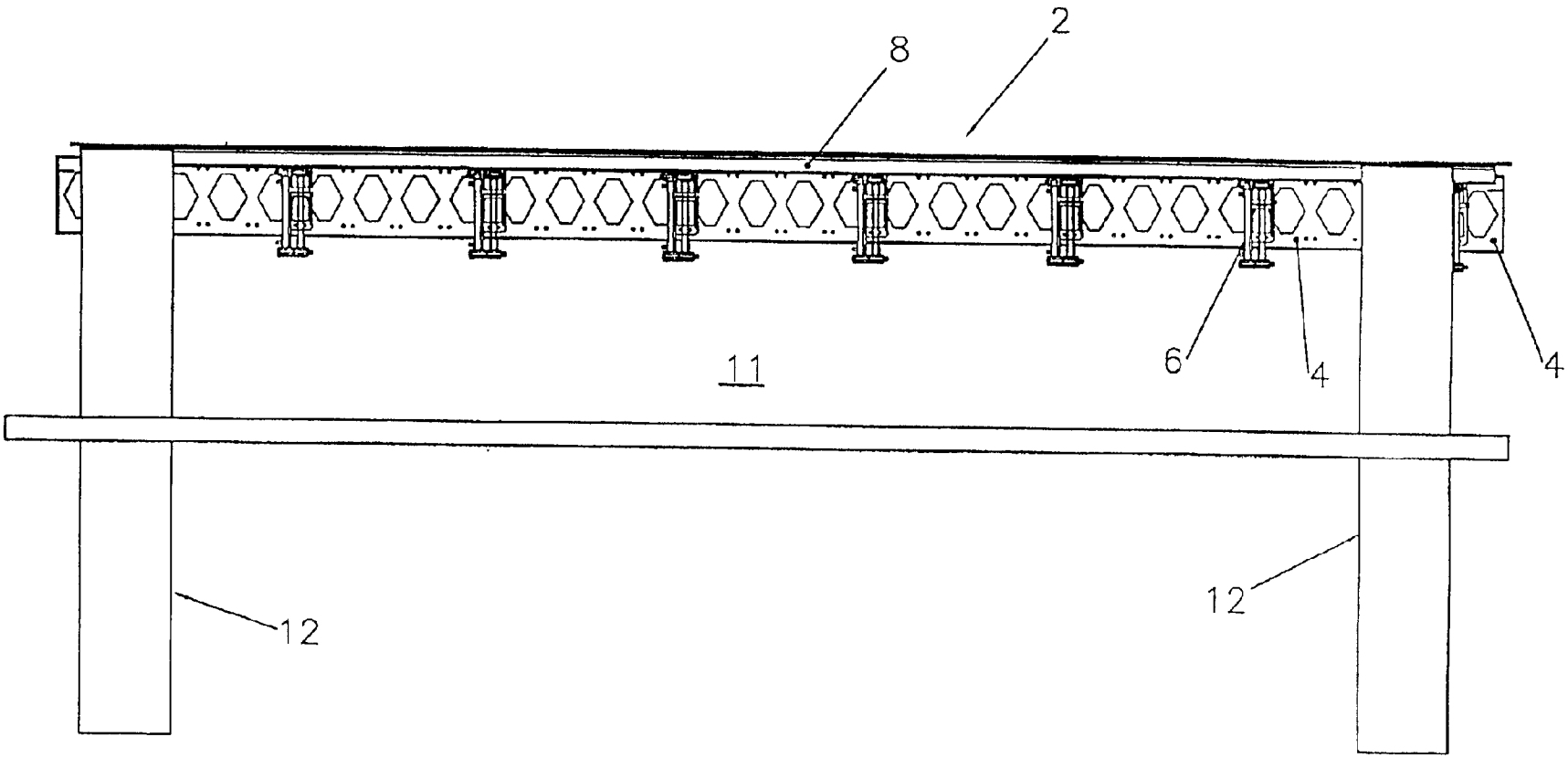
FIG. 2 is a side view of the column hung truss.

FIG. 2 shows the various elements of the flying truss 2 supported within the bay 11 of the building.

Figure 3:
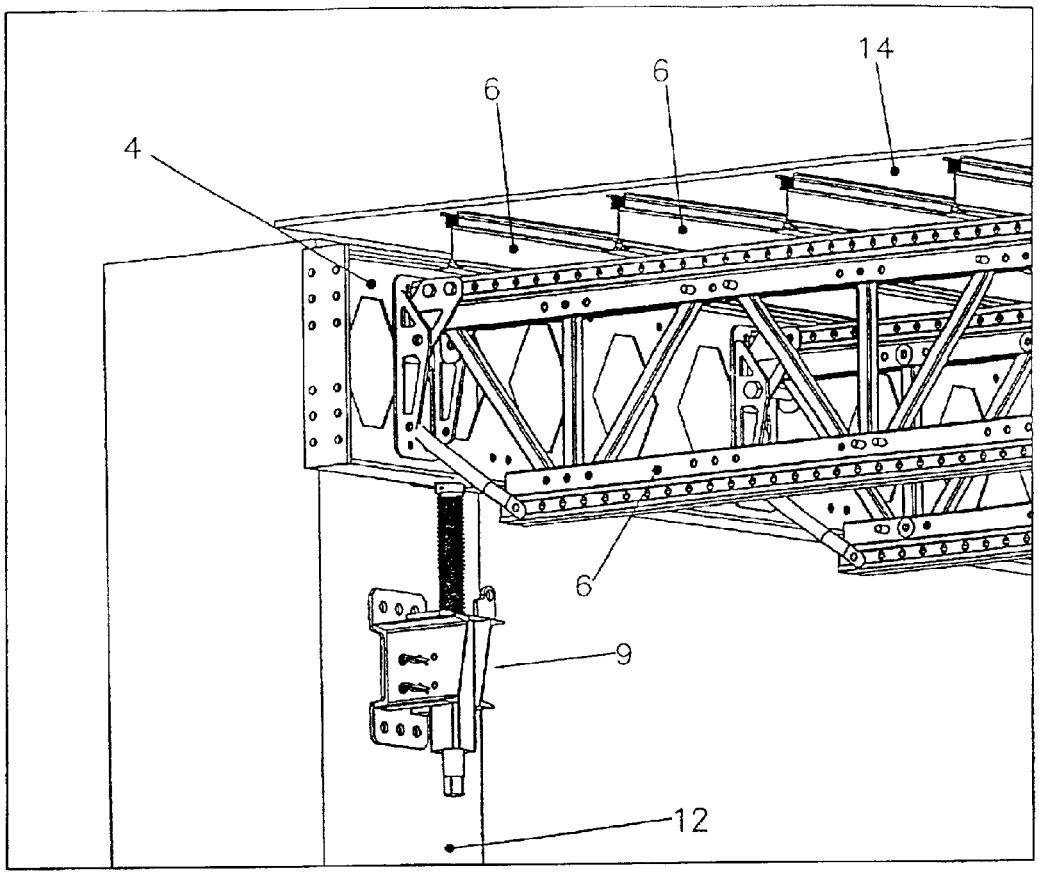
FIG. 3 is a partial perspective view of the column mounted jack.

FIG. 3 shows various details of the column mounted jack 9, the main beams 4 and the transverse beams 6. As shown, the transverse beams 6 are of a composite design and are of a depth which extends below the main beams 4. The increased depth provides greater stiffness and allows further separation of the transverse beams. The spacing between transverse beams 6 will depend on the concrete load, however, this spacing is typically 64 to 108 inches. This spacing is approximately double the spacing necessary if standard bar joist beams are used to carry the same load. The distance between the aluminum alloy runner beams 8 is 16 to 19 inches depending upon the plywood and the thickness of concrete to be poured.

As shown in FIG. 3, the runner beams 8 are preferably of an I-beam section with a center channel for receiving a nailer strip. In this way, the plywood deck 14 may be secured by screws or nails to the nailer strip located in the runner beams.

Figure 7:
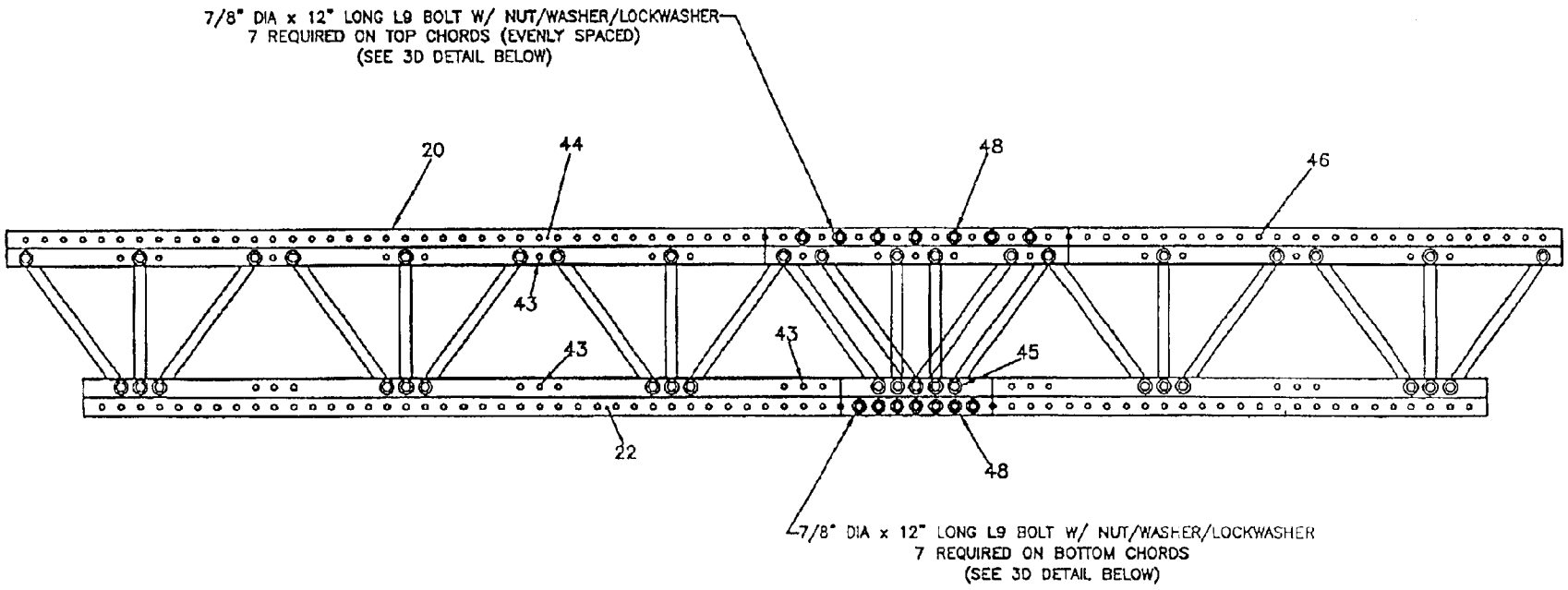
FIG. 7 is a side view of two beam sections secured together.

FIG. 7 shows details of the composite transverse beam 6. The composite transverse beam is made of two beam sections 44 and 46 which are mechanically secured by a series of bolt and nut combinations 48, at the overlapping ends of the two beams. Both the bottom chord and the top chord are mechanically secured using a series of holes in the chord members as generally shown in FIG. 9.

Figure 4:
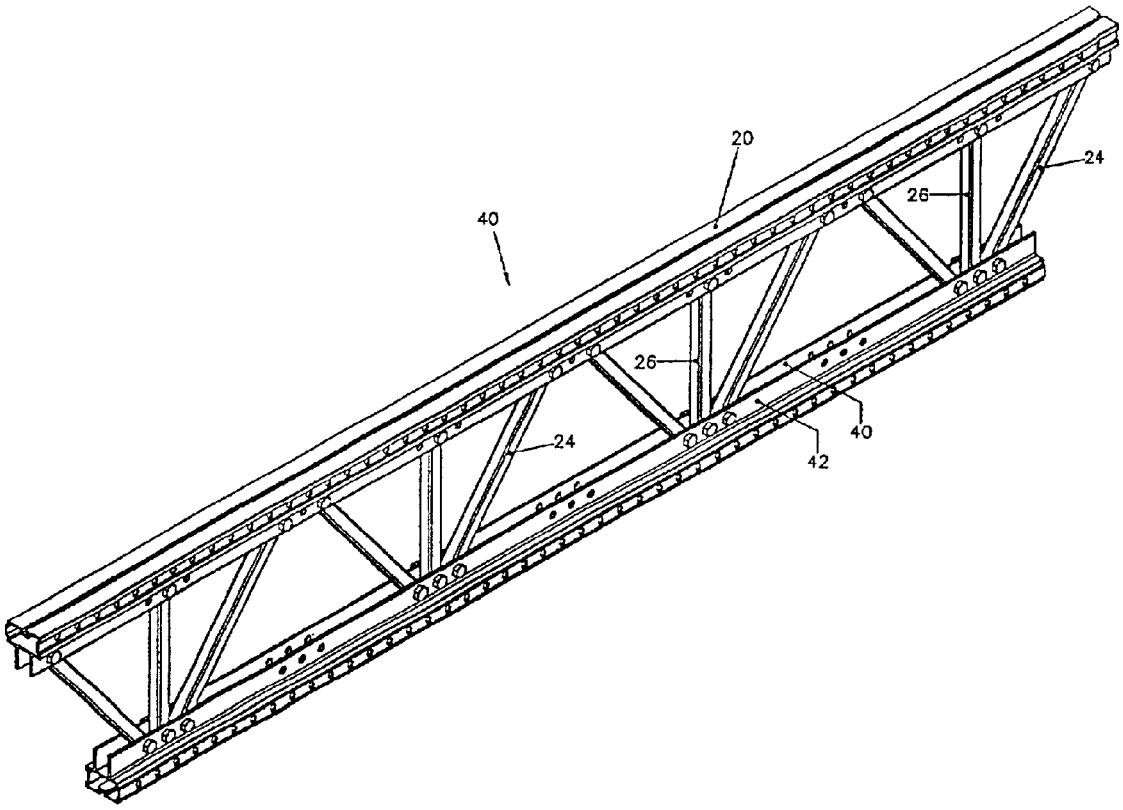
FIG. 4 is a perspective view of a beam section.

One beam section 44 is shown in FIG. 4. This beam section includes a top chord 20, a bottom chord 22 and a series of diagonal bracing members 24 and a series of vertical members 26. Members 24 and 26 are mechanically secured to the top and bottom chords. Each of the chords is of the same structure and has a series of holes 22 extending in the length of the chords. These holes pass directly through the chords and are used to mechanically fasten two sections, one to the other.

Figure 5:
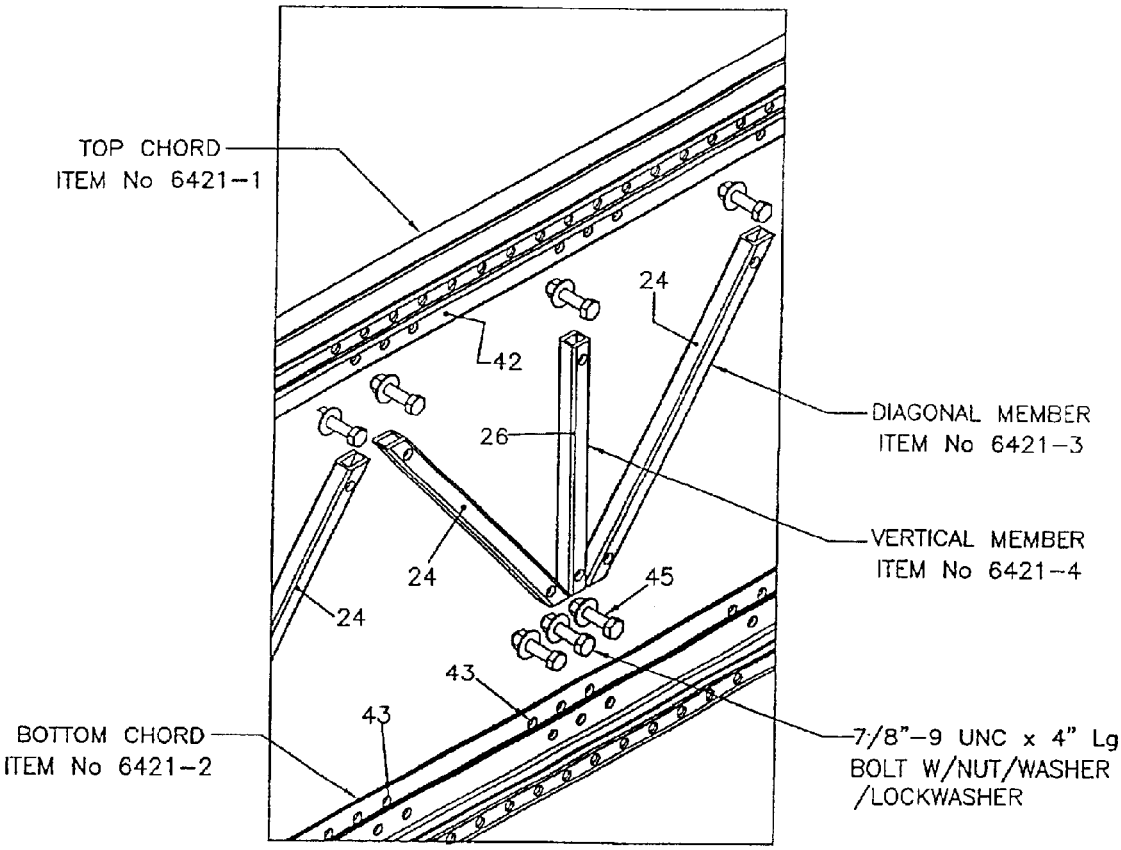
FIG. 5 is an exploded perspective view of part of a beam section.
Figure 6:
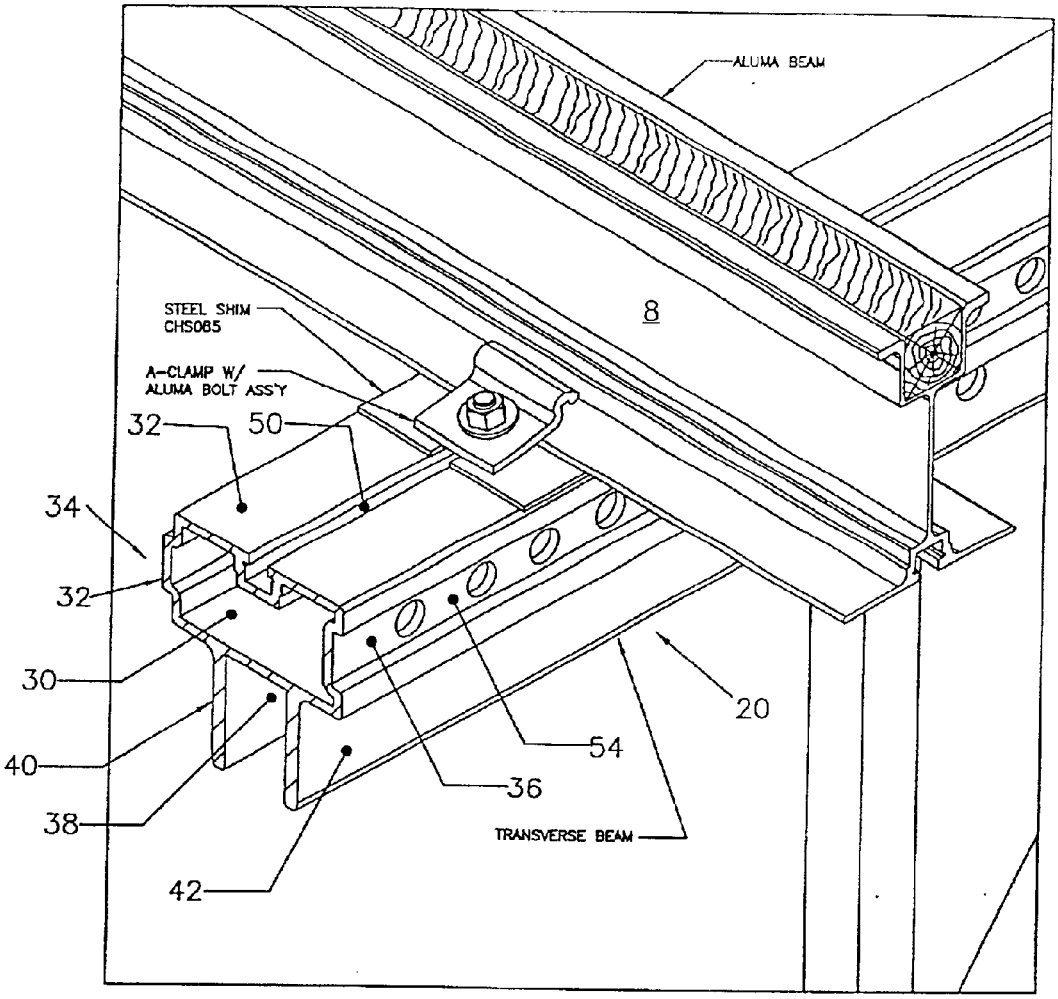
FIG. 6 is a partial perspective view of a beam section supporting a runner beam.

A top chord 20 is shown in FIG. 6, and has a generally rectangular shaped enclosure 30, having a top portion 32, opposed side portions 34 and 36, and a bottom portion 38. The top portion 32 includes a longitudinally extending bolt slot 50 used to mechanically fasten the runner beams 8 to the transverse beams 6. The side portion 34 includes an outwardly extending elongate rail 52 which is sized for receipt in the U-shaped receiving channel 54 in the opposite side 36. The bottom portion 38 includes downwardly projecting securing flanges 40 and 42 centered either side of the center line of the chord and uses to mechanically secure the diagonal and vertical connecting members 24 and 26. As shown in FIG. 5, the securing flanges 40 and 42 have a series of holes 43 at various points in the length of the chord and is used to fasten the connecting members by means of bolts 45.

Figure 8:
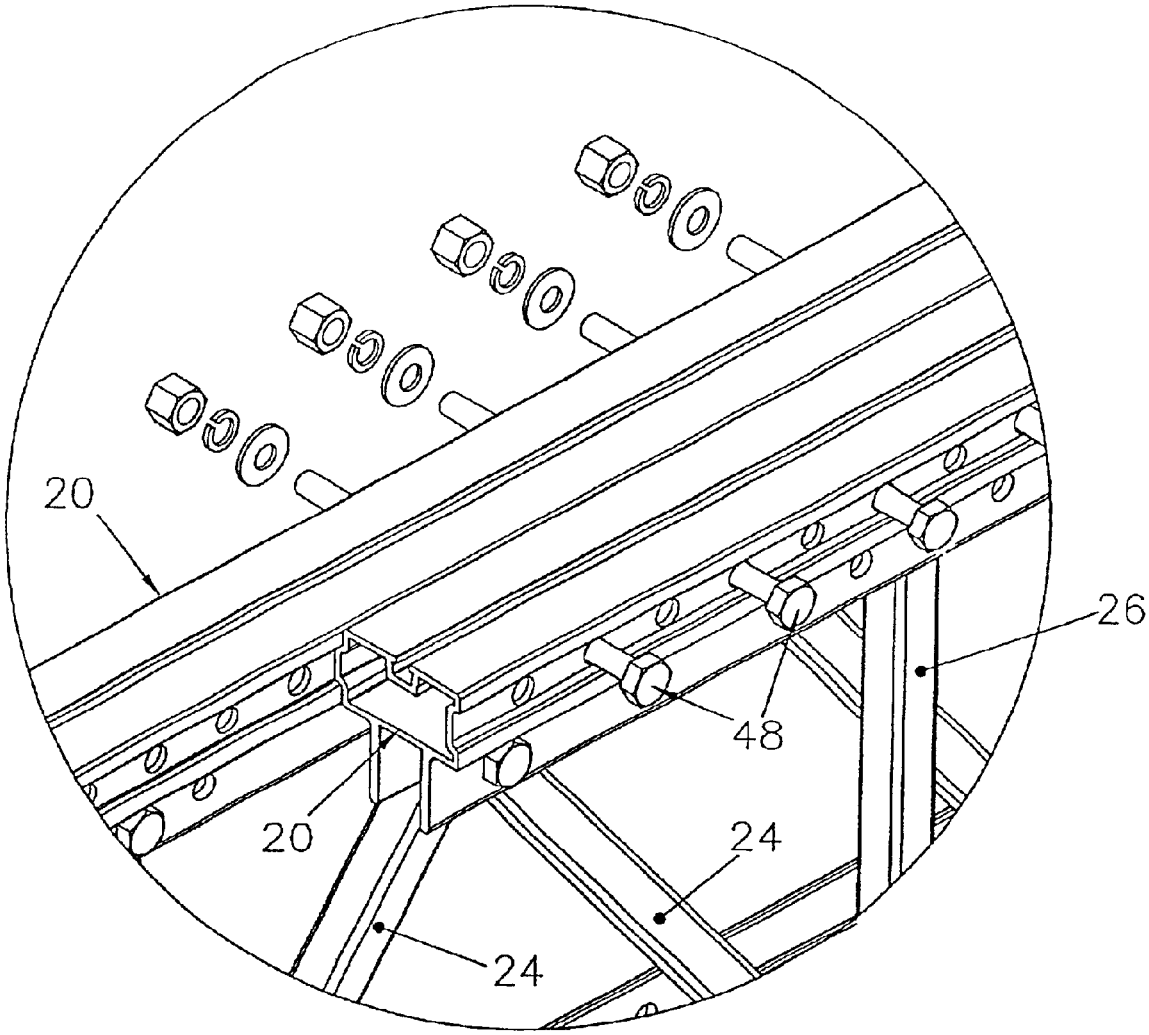
FIG. 8 is a partial perspective view showing the securement of the beam sections.
Figure 9:
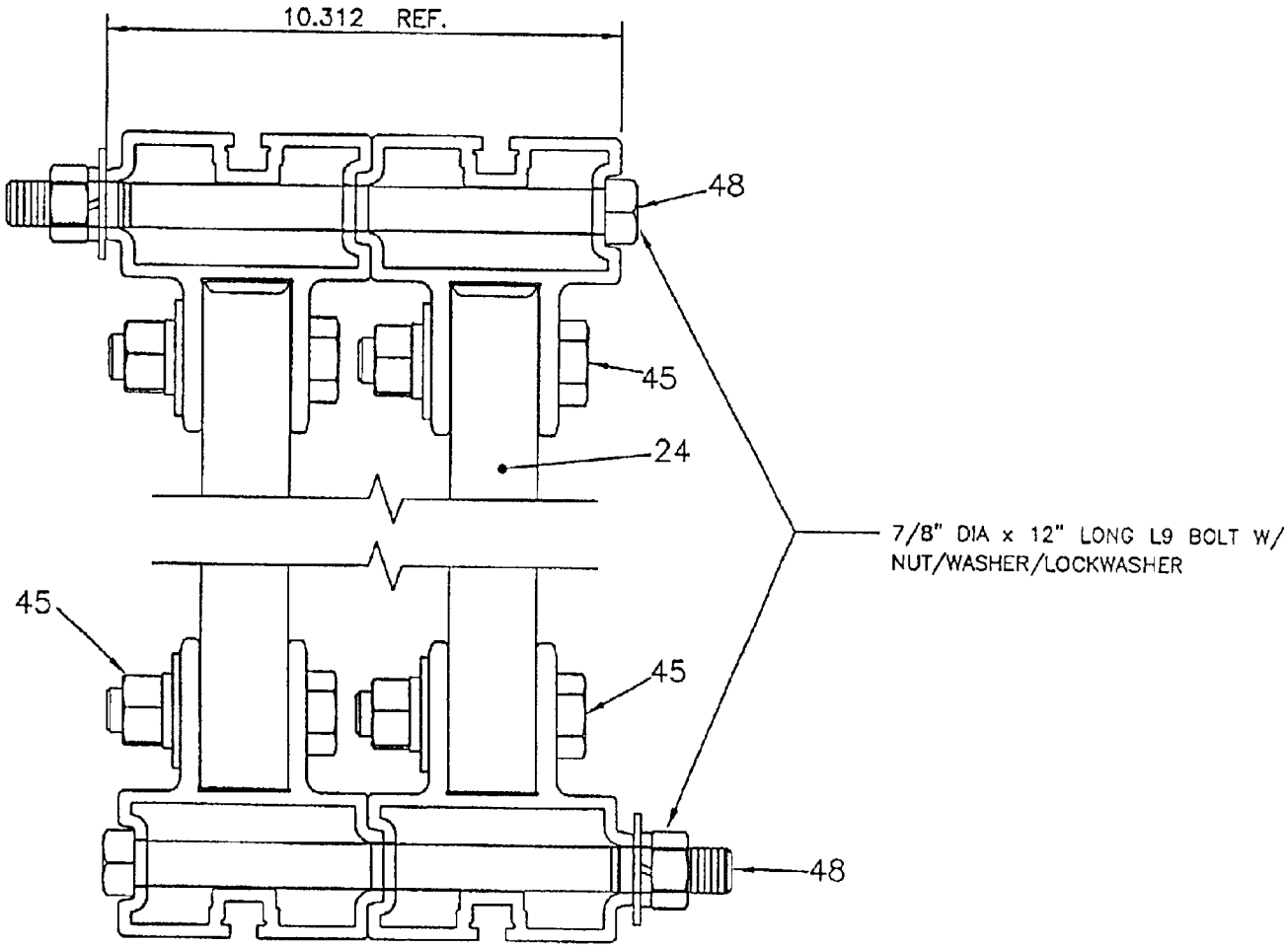
FIG. 9 is a sectional view showing two secured beam sections.
Figure 10:
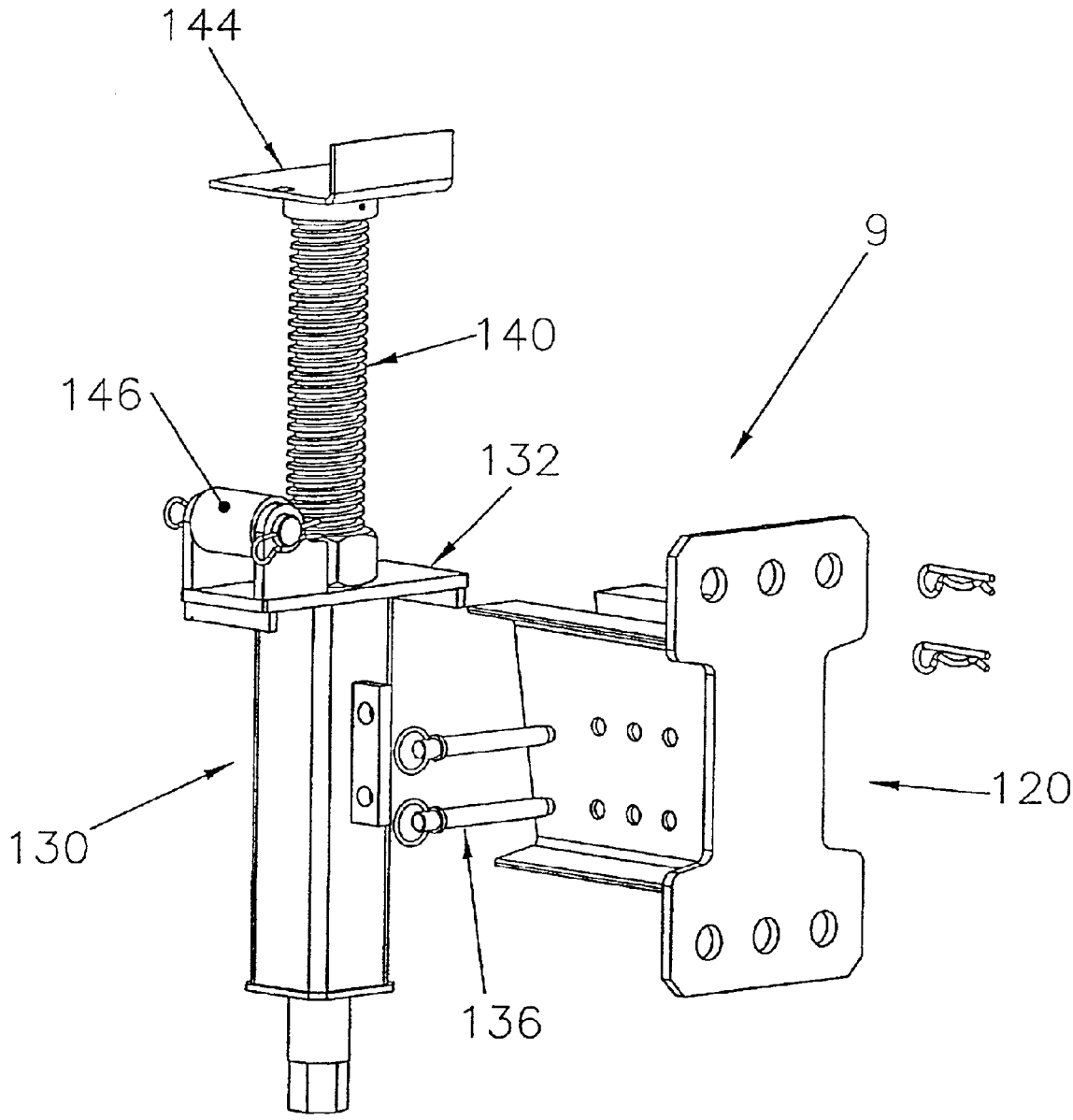
FIG. 10 shows details of the column jack.

The flanges 40 and 42 are positioned inwardly of the sides 34 and 36 with the entire mechanical connection of the connecting members 24 and 26 located in a non interference position when two sections are secured, one to the other, as shown in FIGS. 7, 8 and 9. The side portions of the enclosure 30 are designed to mate and form a mechanical connection opposing racking of the sections when a load is carried by the transverse beam 6. The projecting rail 52 of one beam section 44 is received in the adjacent receiving slot 54 of the other chord member. Bolts 48 pass through the holes and mechanically secure one beam section to the other beam section to form the transverse beam structure 6. The length of the transverse beam 6 may be varied by releasing of the mechanical fasteners 48 and moving the sections one to the other until the desired length is achieved. In this way, the transverse beams 6 can be adjusted in length to accommodate different bay widths. This composite structure also allows for salvaging of components if certain portions of the transverse beam are damaged.

As can be seen, the top and bottom chords are of the identical section and merely reversed in orientation. If damage occurs to either the top chord or the bottom chord, a new chord member can be inserted. It can further be appreciated that damage may have occur to only part of the chord and a portion of the chord may be salvaged for another application.

Figure 11:
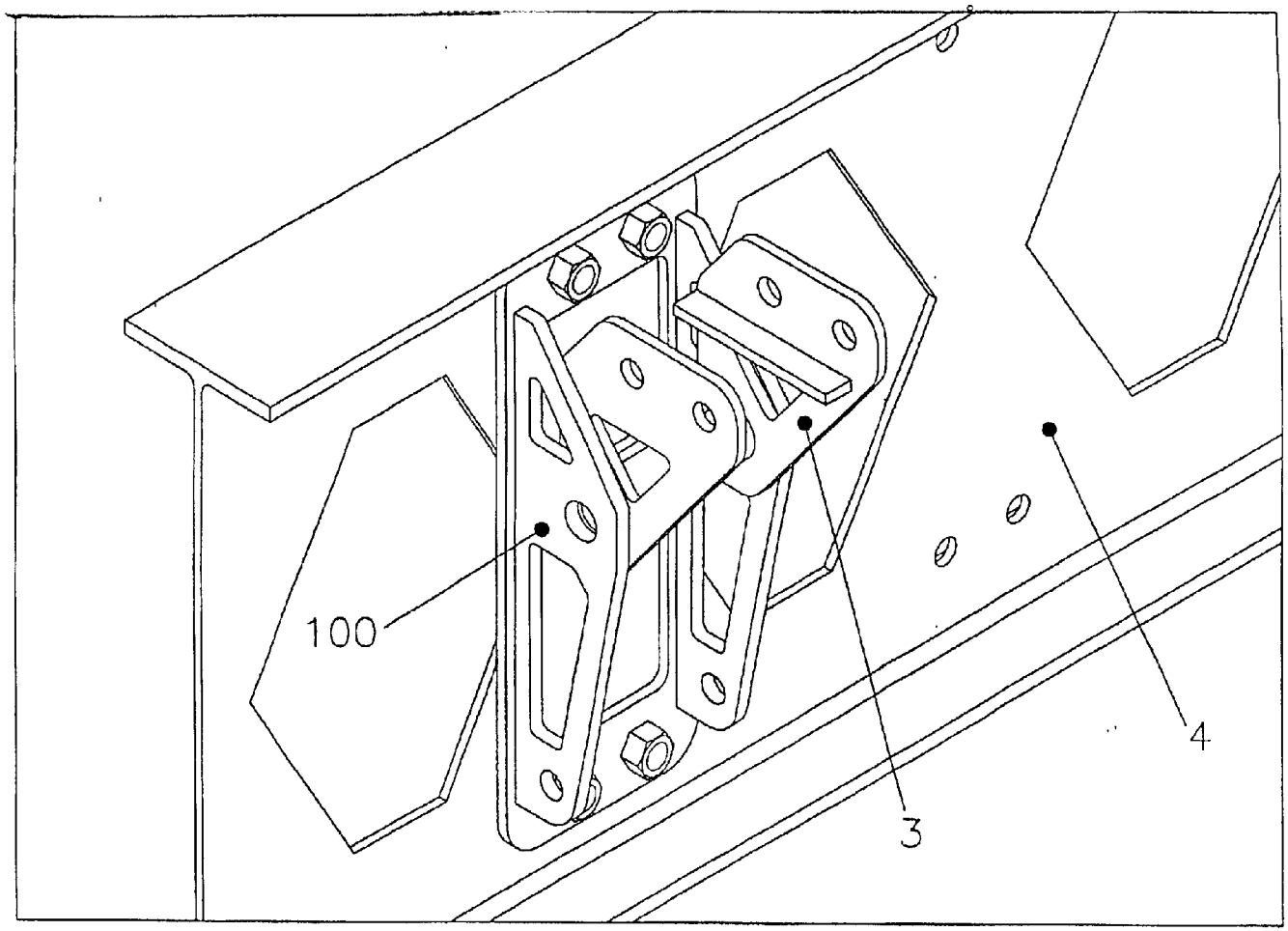
FIG. 11 shows details of a support bracket used to secure the beam sections.
Figure 12:
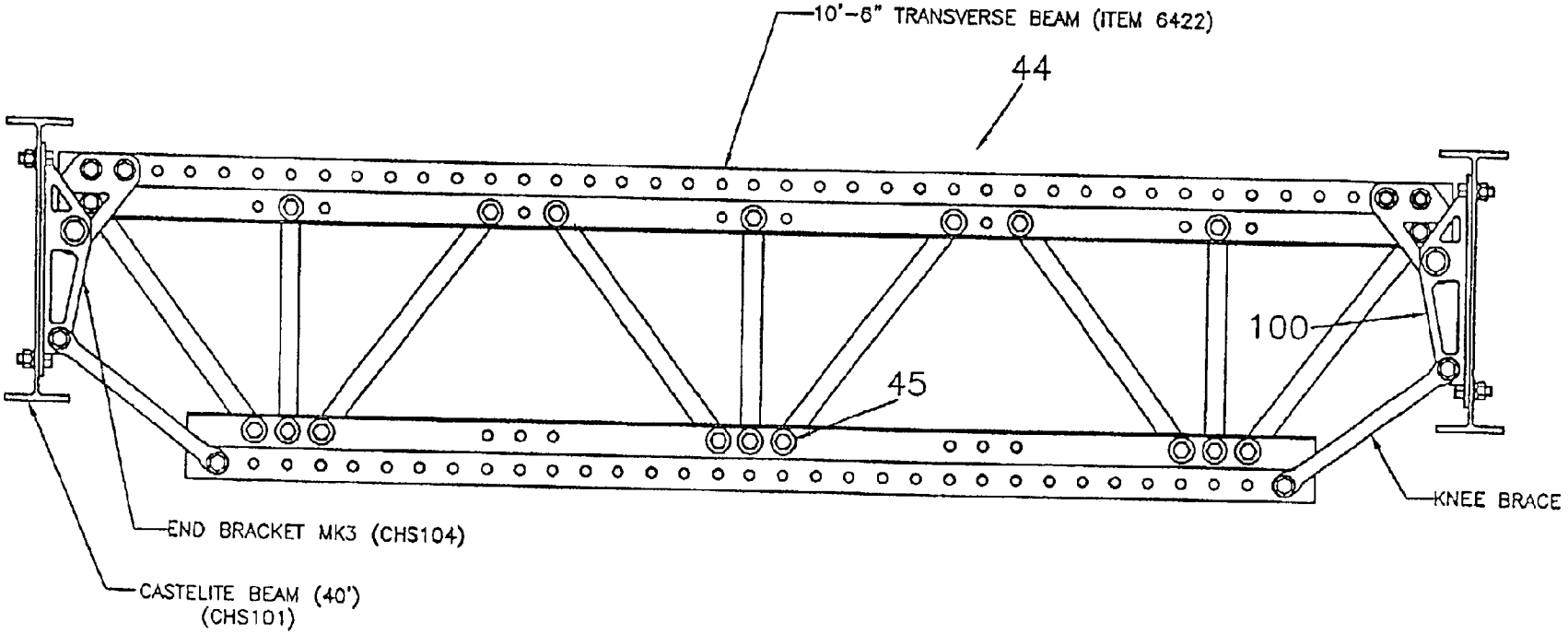
FIG. 12 is a side view of a secured transverse beam.
Figure 13:
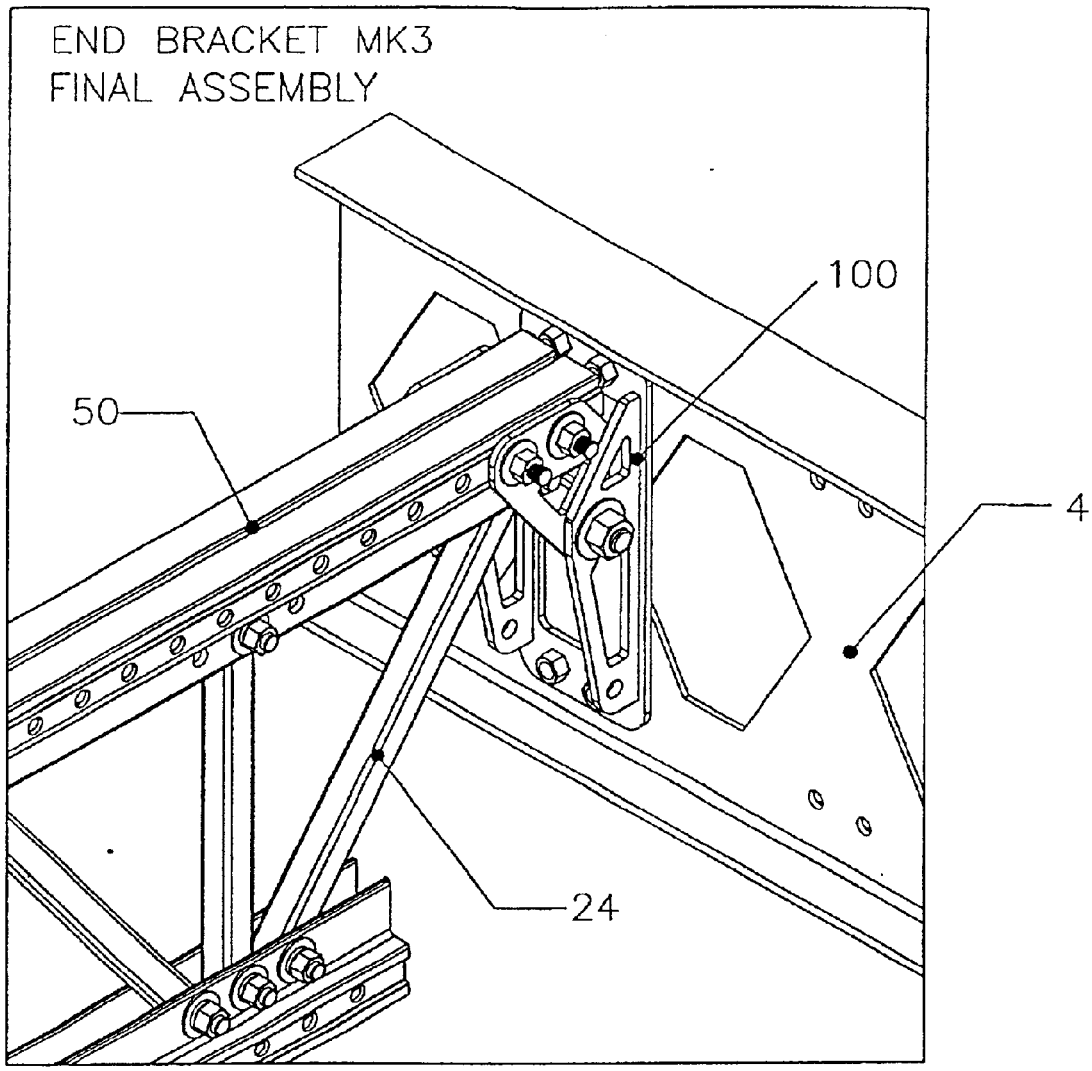
FIG. 13 shows details of a secured beam section to the support bracket.

FIG. 11 and FIG. 12 shows details of the bracket 100 used to secure the transverse beams 6 to the main beams 4. The bracket 100 is mechanically secured to the web 3 of the main beam by a nut and bolt connection which passes through the web and passes through holes in the bracket. The transverse beams are mechanically secured to the brackets using the series of holes in the top chord and appropriate holes provided in the bracket 100. A further brace can extend from the bracket to the bottom chord to increase the stability. Furthermore, the bottom chord members of the parallel spaced transverse beams 6 can be tied one to the other using the bolt slot provided in the bottom chord member to provide bracing. This increases the stiffness and stability of the system.

Figure 14:
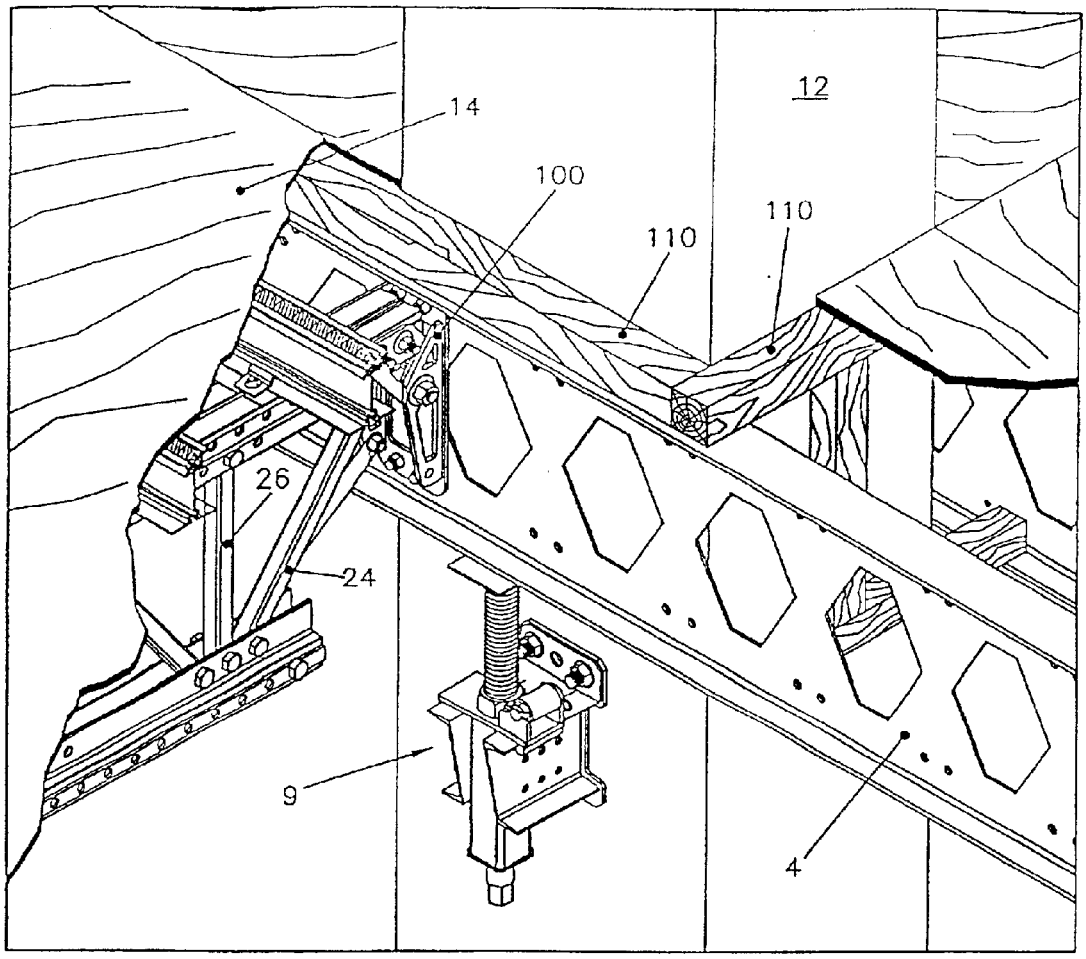
FIG. 14 shows two trusses at a support column.

As shown in FIG. 12, the transverse beams 6 are secured to the main beams 4 at a position below the top of the main beams 4. The transverse beams 6 are designed to support the extruded aluminum runner beams 8 which have an overall height of approximately six and one half inches. The upper surface of each runner beam 8 is three and one half inches above the top of the main beams 4. In this way, a series of wooden four-by-fours 110 can be positioned on the main beams 4 and across the main beams 4 to surround the column 12 and provide a support surface for the plywood deck 14 adjacent the column. In this way, the packing around the columns for supporting the concrete floor adjacent the column is relatively simple and straightforward. This aspect is clearly shown in FIG. 14.

The transverse beams 6 are of a design such that the beam sections cooperate with one another along the top and bottom chords to oppose racking of the sections when the beams are loaded. The beam sections are mechanically secured one to the other and allow for ready adjustment in length of the transverse beams. As can be appreciated, for a given building structure, the bay width is essentially constant and therefore, the truss can be used for forming of the bay floor and then repositioned for forming of the floor thereabove. In many cases, the bay sizes will be somewhat standardized and there will be no requirement to vary the length of the transverse beams. In some cases due to the particular building design, the bay width may be somewhat unusual and thus, the transverse beams can be adjusted in length, to allow formation of the truss of appropriate width.

Figure 15:
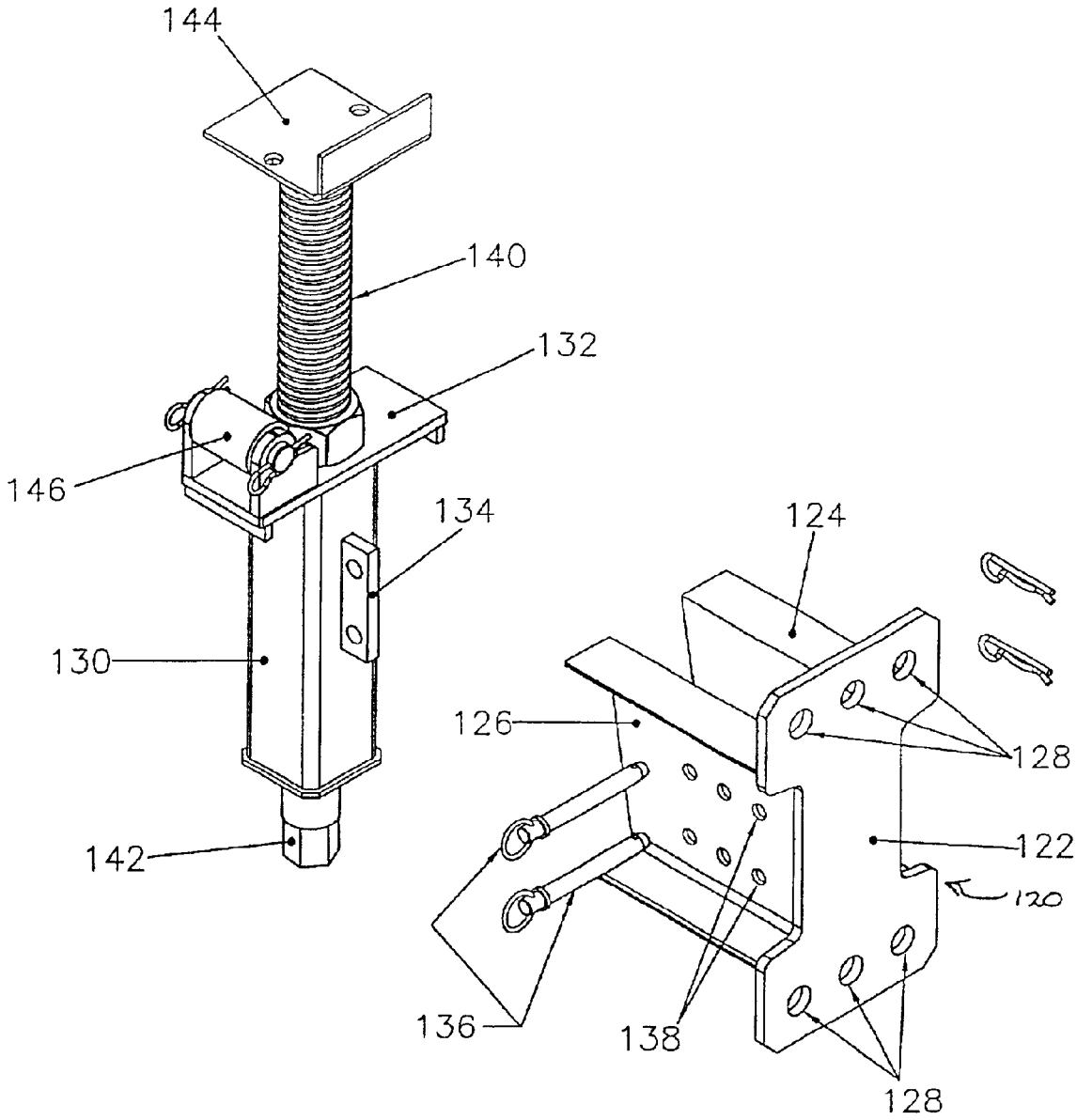
FIG. 15 shows further details of the column hung jack.

Details of the column hung jack assemblies are shown in FIG. 15. A U-shaped saddle member 120 includes a column engaging plate 122 having two outwardly extending arms 124 and 126. The column engaging plate 122 is mechanically secured to the column using any of the series of holes 128. These holes allow for aligned or offset bolts. The adjustable jack 130 is received between the arms 124 and 126 and has an overlapping top slide plate 132. The jack has a securing flange 134 which cooperates with releasable pins 136 to locate the jack at one of three positions shown in FIG. 15. Each position is shown by one of the pair of vertically aligned locking pin ports 138. The jack assembly includes a screw member 140 which can be adjusted by means of the bolt adjustment 142 for raising and lowering of the support plate 144. The support plate 144 engages the lower flange of one of the main beams 4. To allow movement of the truss out of the bay, the jack is adjusted to drop the main beams onto the support rollers 146 and thereafter, the truss may be moved out of the bay and raised to the next level. The column hung jack assembly of FIG. 15 allows for minor variation in the spacing of the columns and allows for effective transfer of the loads through the jack to the columns 12.

It is preferred that the composite structural beams 44 and 46 be made of an extruded aluminum alloy components or similar lightweight high strength component. The top chord and the bottom chord are of the identical structure and the diagonal connecting members and the vertical members are tube members with relatively thick sidewalls which have the holes for connecting of the member to the chords and thinner end walls.

The transverse beams 6 can be spaced along the main beams 4 anywhere from 64 inches to 108 inches apart. The actual separation of the transverse beams 6 will be determined by the thickness and weight of the slab being poured.

The flying form truss, due to the large size thereof, is assembled onsite and is dismantled once the building is complete. The individual components are transported to and from the site and between jobs are stored in a construction yard. The transverse composite beams can be stacked sideways, one on top of the other, and interfit to maintain the stack. This stacking is particularly convenient with the individual beam sections. The projecting, elongate rail 52 is received in a U-shaped receiving channel of an adjacent beam section. This stabilizes the stack and is helpful in transportation and storage.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. An extruded elongate metal structural component comprising in cross section a hollow section having a top securing section, first and second opposed side securing sections and a bottom securing section; said top securing section including a generally flat top surface with a recessed bolt slot centrally located in said top securing section and extending in the length of said structural component; said side sections having complementary shapes with said first side securing section including a recess extending the length of said structural component and said second side securing section including a projecting section sized for snug receipt in said recess of said first side section; said bottom securing section including at least one downwardly projecting securing flange extending in the length of said structural component.

2. An extruded elongate structural component as claimed in claim 1 wherein said component is an extruded aluminum alloy component.

3. An extruded elongate structural component as claimed in claim 1 wherein said hollow section is of a generally rectangular cross section.

4. An extruded elongate structural component as claimed in claim 3 wherein each side section has a series holes extending there through and aligned with the holes through the other side section.

5. An extruded elongate structural component as claimed in claim 3 wherein said at least one downwardly projecting securing flange is two downwardly projecting securing flanges disposed in parallel relationship either side of a centerline of said bottom section with said bolt holes of each flange aligned for receiving bolts extending across said flanges.

6. An extruded elongate structural component as claimed in claim 5 wherein said securing flanges include a series of securing holes passing through said flanges and spaced in the length of said structural component.

7. An extruded component as claimed in claim 5 wherein said recess of said first side section is of shallow U shaped section which dominates said first side section and said projecting section of said second side section includes opposed upper and lower shoulders for engaging said first side section either side of said shallow U shaped section.

8. An extruded elongate structural component as claimed in claim 1 wherein said hollow section has a series of connecting ports through the side securing sections with the ports spaced along the length of the structural component.

9. An extruded elongate structural component as claimed in claim 8 wherein said ports are aligned in pairs and each pair forms a passageway through said hollow section perpendicular to said side securing sections.

10. An assembled structural support comprising a top chord and a bottom chord mechanically connected by series of diagonal connecting members, said top chord including on an upper surface a longitudinally extending bolt slot, said bottom chord including on a bottom surface a longitudinally extending bolt slot, each of said top chord and said bottom chord having two opposed side surfaces with a shallow channel recess in one side surface and extending the length of said chord and a complementary projection on the opposite side surface and extending the length of said chord sized for receipt and mating engagement in said shallow channel recess; each of said top chord and said bottom chord being an extruded component and including a securing flange which cooperates with said diagonal connecting members to secure said top chord to said bottom chord; and wherein said top chord and said bottom chord are of the same cross section.

11. An assembled structural beam as claimed in claim 10 wherein said top chord includes a hollow cavity running the length thereof.

12. An assembled structural beam as claimed in claim 11 wherein said chords and said diagonal connecting members are extruded aluminum alloy components.

13. An assembled structural beam as claimed in claim 12 wherein said diagonal connecting members are secured to said chords using mechanical fasteners.

14. An adjustable in length header beam comprising two beam sections secured one to the other in an overlapping manner, each beam section being an assembled structure having a top chord, a bottom chord and a series of connecting members secured therebetween; said top chords and said bottom chords of said beams including interfitting surfaces which maintain alignment of said beam sections relative to each other, said beam sections further including a series of holes in said top and bottom chords and a plurality of structural fasteners passing through aligned holes in said chords and in combination with said interfitting surfaces mechanically securing said beam sections; and wherein said beam sections are of the same cross section, and said chords are formed by extrusion and each chord has an extending member on one side and a corresponding receiving channel on the opposite side thereof.

15. An adjustable in length header beam as claimed in claim 14 wherein said top chord and said bottom chord are of the same cross section.

16. An adjustable in length header beam as claimed in claim 14 wherein said header beam is stackable with like header beams with said interfitting surfaces engaging to partially maintain the stack of beams.

* * * * *